United States Patent [19]

Pridgen

[11] Patent Number: 4,700,494

[45] Date of Patent: Oct. 20, 1987

[54] APPARATUS FOR DRYING HAIR SPRAY AND OTHER COMPOSITIONS

[76] Inventor: Danny W. Pridgen, P.O. Box 2204, Pine Circle, Gainesville, Ga. 30503

[21] Appl. No.: 907,230

[22] Filed: Sep. 15, 1986

[51] Int. Cl.[4] ..... A45D 20/00

[52] U.S. Cl. ..... 34/90; 34/97; 132/9; 416/246

[58] Field of Search ..... 34/90, 97; 132/7, 9, 132/11, 112, 114; 98/1; 416/63, 170 C, 247 R, 246; 417/41

[56] References Cited

U.S. PATENT DOCUMENTS 2,817,158 12/1957 Kohn ..... 34/90

3,200,731 8/1965 Hart, Jr. ..... 98/1

3,797,475 3/1974 Hughes ..... 34/90

4,523,080 6/1985 Bolton ..... 34/90

*Primary Examiner*—Larry I. Schwartz

*Attorney, Agent, or Firm*—Needle & Rosenberg

[57] ABSTRACT

A portable, lightweight and simple device which dries hair spray and other compounds as they are applied to the hair from a container is comprised of rotatable fan blades driven by a battery powered motor. A battery holder is attached to the container and holds the battery in place. An adjustable, flexible conduit is provided for supporting the motor and fan blades in a chosen position in relation to the container, and houses wires for conducting current from said battery to the motor.

6 Claims, 3 Drawing Figures

APPARATUS FOR DRYING HAIR SPRAY AND OTHER COMPOSITIONS

BACKGROUND OF THE INVENTION

1. Field of the Invention

This apparatus relates to the field of hair dressing and styling, and more particularly to the drying of hair spray and other compositions of matter which give fragrance, color, body or sheen to hair.

2. Description of the Prior Art

The dressing and styling of hair often requires application of hair sprays or other compositions of matter which give fragrance, color, body or sheen to the hair. These compositions are usually applied by means of spraying from an aerosol or nonaerosol can or container. The composition is a liquid under pressure in the can.

To achieve proper results, it is necessary that the spray be dry before styling the hair. A problem is encountered, therefore, when spray leaving the can or container retains its liquid properties. This results in the hair upon which the spray is applied becoming wet with spray, thereby necessitating an unwanted drying period between the application of the spray and the styling. To shorten this period, stylists have resorted to the additional steps of drying the hair and hair spray with a blow drying device. This procedure, however, is also time consuming as well as cumbersome. Furthermore, to accomplish adequate results, it is often necessary to perform the steps of applying spray and drying repeatedly. This further increases the time required for each styling, and also limits the ability of the stylist to achieve the desired final results. A more recent problem encountered in hair styling involves the trend towards the use of "spritz" type hair sprays. This type of spray has even greater liquid properties upon leaving the can or container, and therefore, requires more drying time before styling can be performed.

U.S. Pat. No. 4,524,080 describes an apparatus which combines a blow dryer device and aerosol spray can in combination. This device, however, is bulky and cumbersome because of its size and weight, and requires electricity to operate; thereby restricting both where and how it is used.

Also, the '080 device accomplishes drying by means of a heater within the apparatus, thereby causing potential danger when flammable sprays are used, particularly those containing lacquer.

Therefore, there is no convenient, safe and simple apparatus for one-step drying of hair spray.

SUMMARY OF THE INVENTION

The invention is a portable, lightweight and simple device which dries hair spray and other compounds as they are applied to the hair from an aerosol and nonaerosol can or container. The invention provides for continuous application of dried spray during the styling process, thereby eliminating the drying period and the need for a blow drying device.

A battery powered blowing means is attached to a spray container such that spray exiting the container is dried as it travels through and beyond the blowing means. One embodiment of the blowing means is comprised of a combination propeller and shroud, located in front of the hole from which the spray exits the container. The rotation of the propeller provides sufficient blowing effect to dry and disperse the spray as it leaves the container and travels to the hair. An electric motor, preferably of 3 volt D.C. type, is provided as a means of operating the blowing means. The motor is powered by a battery which is attached to the container by either a strap, adhesive, or otherwise. A push button switch allows conduction of current between the motor and the battery, thereby enabling the operator to control the blowing means as needed. The button may be located atop the battery holder and connected to the motor by wires contained in a flexible conduit, or may be placed over the spray release button of the container so that the blower may be activated and the spray removed from the container simultaneously using a single finger. The flexible conduit makes it possible to position the blowing means in whatever manner is desired to achieve optimum results in styling.

Therefore, it is a goal of the invention to provide an apparatus which can be used as a means for drying hair spray and other compositions as it leaves a container. This results in increased handling and manueverability of hair during styling, and thereby increases the number of potential hairstyles available. Another object of the invention is to provide a device that results in greater dispersal of hair spray and other compounds. It is a further objective to provide such a means which is simple in design and operation, as well as lightweight.

The present invention eliminates the need for a heater means by locating the blower means closer to the nozzle of the can or container from which the spray exits. Because no heating means is present, the dangers of using flammable sprays are greatly reduced.

These and other objects and advantages will appear from the following description with reference to the drawings.

DESCRIPTION OF THE PREFERRED EMBODIMENT

The preferred embodiment is now described with reference to the drawings, in which like numbers indicate like parts throughout the views.

Figure 1:
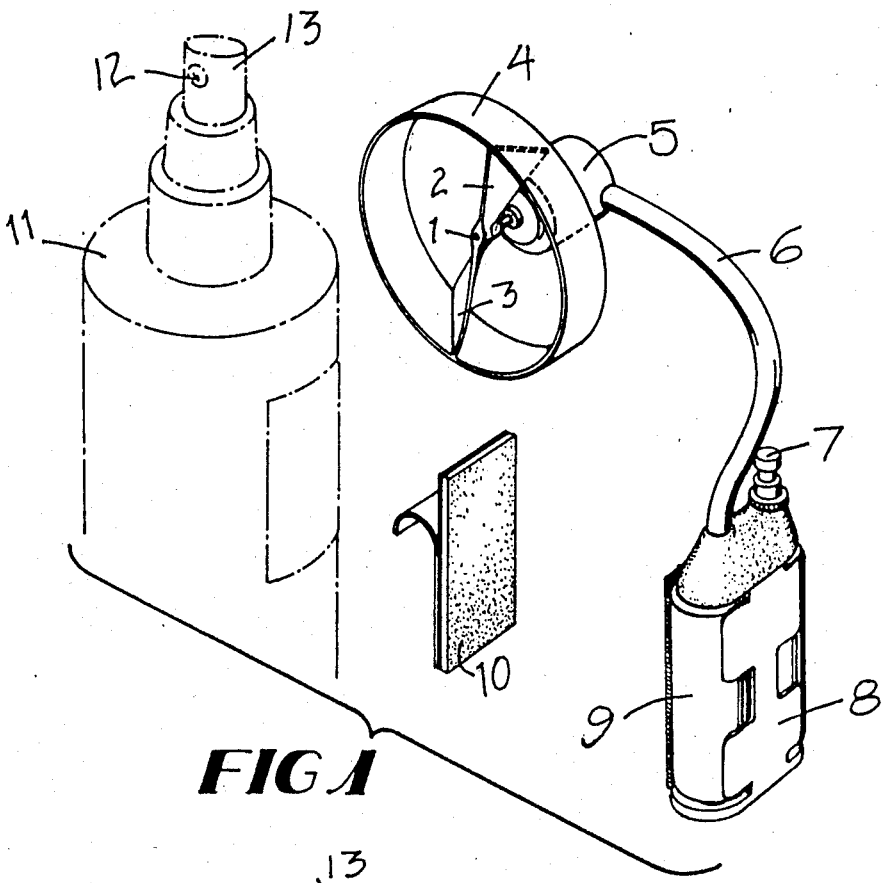
FIG. 1 is a lateral view of the apparatus.

FIG. 1 shows the elements of the apparatus for drying hair spray and other compounds which comprises a propeller 1 consisting of fan blades 2 and 3 and surrounded by a protective shroud 4. The propeller 1, fan blades 2 and 3, and shroud 4 are positioned in front of the point of exit of spray 12 from the container 11. Spray exiting the container travels through and is dried by the rotating fan blades 2 and 3. The propeller 1 is attached to a motor 5 which provides the means for propeller 1 rotation. The motor 5 is connected to a battery 9 by means of a flexible conduit which houses conducting wires. The conduit 6 is flexible so as to allow positioning of the propeller 1 and fan blades 2 and 3 as desired, as well as to allow the apparatus to be used on various sizes containers. A push button switch 7 is located between the motor 5 and battery 9. Depression of the switch 7 completes the current between the motor 5 and battery 9, thereby activating the motor 5.

Figure 2:
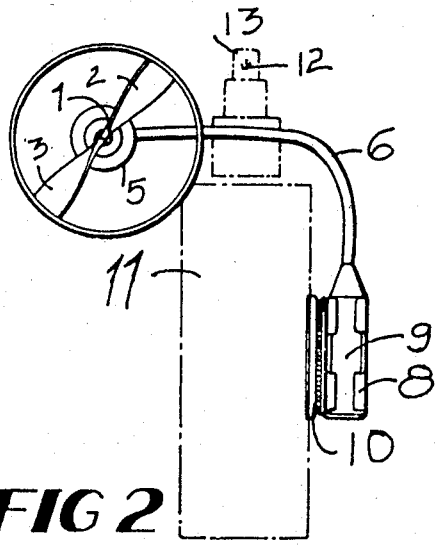
FIG. 2 is a frontal view of the apparatus.

FIG. 2 shows the battery 9 as held in place by a battery holder 8, and which in turn is attachable to the container 11 by means of a strap or a hook and loop type attachment device 10, such as a Velcro fastener. A switch 7, which can be located either on the battery holder 8 or above the spray button 13 of the container 11, permits, when pushed, current to flow from the battery 9 through the flexible conduit 6 to the motor 5. Locating the switch on the battery holder adds to simplicity of design, while locating it above the spray button 13 allows operation of both the switch 7 and spray button 13 with one finger.

Figure 3:
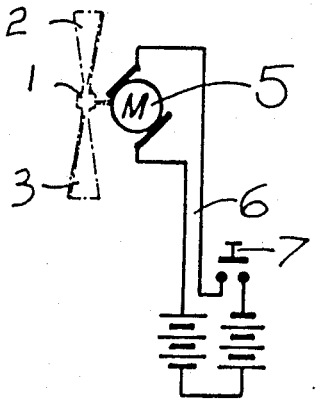
FIG. 3 is a cross section of the apparatus.

FIG. 3 shows the circuitry wherein current from the battery 9 to the motor 5 powers the rotation of the fan blades 2 and 3, which in turn creates a blowing effect that dries hair spray as it leaves the point of exit 12 of its container 11 and travels through the area inside the shroud 4 and then to the hair being styled.

While the invention has been described in detail with particular reference to the preferred embodiment thereof, it will be understood that variations and modifications can be effected within the spirit and scope of the invention as previously described and as defined by the claims.

What is claimed is:

1. An apparatus for drying hair spray or other compositions released from a container comprising:

rotatable fan blades for drying spray as it leaves said container;

a motor for rotating said fan blades;

a battery holder attached to said container for holding a battery for supplying power to said motor;

an adjustable flexible conduit for supporting said motor and said fan blades in a chosen position in relation to said container and housing a wire for conducting current from said battery to said motor; and a switch for controlling the operation of said fan blades.

2. The apparatus of claim 1, wherein said fan blades are connected to a protective shroud so that said shroud is connected to and surrounds said fan blades.

3. The apparatus as described in claim 1 wherein said battery holder is attached to said container by means of a strapping device.

4. The apparatus as described in claim 1 wherein said battery holder is attached to said container by means of a hook and loop type connection device.

5. The apparatus as described in claim 1 wherein said switch means is located atop said battery holder.

6. The apparatus as described in claim 7 wherein said switch for providing a means for opening and closing a circuit between said motor and said battery is located atop the spray-release button of said container so that both switch and said spray-release button can be depressed using a single finger.

* * * * *